US007150551B2

(12) United States Patent
Capello et al.

(10) Patent No.: US 7,150,551 B2
(45) Date of Patent: Dec. 19, 2006

(54) COMPLEX REFLECTOR FOR A VEHICLE HEADLAMP, AND METHOD FOR THE MANUFACTURE OF THE REFLECTOR

(75) Inventors: Davide Capello, Orbassano (IT); Piermario Repetto, Orbassano (IT); Pietro Perlo, Orbassano (IT)

(73) Assignee: C.R.F. Societa Consortile per Azioni (IT)

( * ) Notice: Subject to any disclaimer, the term of this patent is extended or adjusted under 35 U.S.C. 154(b) by 80 days.

(21) Appl. No.: 10/910,347

(22) Filed: Aug. 4, 2004

(65) Prior Publication Data

US 2005/0057940 A1 Mar. 17, 2005

(30) Foreign Application Priority Data

Aug. 5, 2003 (IT) ..... TO2003A0612

(51) Int. Cl.
*F21V 7/00* (2006.01)

(52) U.S. Cl. ..... 362/518; 362/297; 362/348

(58) Field of Classification Search ..... 362/507, 362/514, 516, 518, 297, 296, 299, 300, 346, 362/348

See application file for complete search history.

(56) References Cited

U.S. PATENT DOCUMENTS 3,700,883 A * 10/1972 Donohue et al. ..... 362/518
4,530,042 A * 7/1985 Cibie et al. ..... 362/309
5,192,124 A * 3/1993 Kawashima et al. ..... 362/518
5,432,685 A * 7/1995 Taksukawa et al. ..... 362/518
5,931,574 A * 8/1999 Uchida ..... 362/518
6,007,224 A 12/1999 Jiao et al.

FOREIGN PATENT DOCUMENTS

EP 0 735 309 A 10/1996
FR 2 780 136 A 12/1999

* cited by examiner

*Primary Examiner*—Renee Luebke
*Assistant Examiner*—Gunyoung T. Lee
(74) *Attorney, Agent, or Firm*—Cook, Alex, McFarron, Manzo, Cummings & Mehler, Ltd.

(57) ABSTRACT

A reflector for a vehicle headlight is described, capable of illuminating the surrounding space according to a predetermined light distribution. The reflector is formed of a plurality of sectors capable of reflecting the light beam emitted by a light source of the headlight and directing it into predetermined regions of said light distribution. The major part of the sectors of the reflector is delimited at least in part by an edge in which the divergence value of the light beam reflected at said edge portions is constant. The sectors delimited by edge portions having lower values of the angle of spread are arranged to direct the light beam reflected thereby into the regions of the light distribution having a higher spatial gradient of illuminance.

8 Claims, 3 Drawing Sheets

COMPLEX REFLECTOR FOR A VEHICLE HEADLAMP, AND METHOD FOR THE MANUFACTURE OF THE REFLECTOR

BACKGROUND OF THE INVENTION

The present invention refers to a reflector for a vehicle headlight of the complex type, i.e. formed of a plurality of sectors oriented so as to permit the illumination of the surrounding space according to a predetermined light distribution.

Stylistic and performance requirements have always pushed the motor vehicle industry towards the use of headlights of reduced dimensions, with a smooth transparent element and complex reflecting surfaces. The principal problems in the designing of a reflector of this type are the limitation of dazzle in the dipped light beam, and the control of the light beam for the formation of the distribution of illumination according to the regulations. As may be seen from FIG. 1, according to the European regulations, the shape of the dipped light beam must be such as to form on a plane located at a specific distance from the headlight a light distribution which exhibits an abrupt variation of illuminance in the vertical direction at the horizontal axis, or axis x, located at the same height as the optical axis of the reflector. Such a discontinuity, known as cut-off, is necessary in order to guarantee a maximum value of illuminance immediately below the horizontal line and an almost zero illuminance value immediately above said line.

The angle of spread (or divergence) of the light beam reflected by each point of the reflector depends on the dimension of the virtual source at that point and on the distance between the source and the point on the reflector. In particular, it is important to consider the vertical angle of spread θ, or the angle of spread in the direction perpendicular to the plane of the road.

In order to obtain a predetermined light distribution, for example of the type described above, the conventional reflectors have a surface sub-divided into a plurality of facets for directing the light beam from a light source into predetermined zones of the distribution. A reflector for headlights of this type is known for example from U.S. Pat. No. 6,007,224. That patent describes a method for producing the reflector which provides for the arrangement of a plurality of facets of the reflector, the shape of which is established beforehand, to form a desired image of the source. The said patent further provides for the facets furthest from the light source to be intended to provide light to a region with greater light intensity of the light distribution generated, and for the facets closest to the light source to be intended to provide light to the regions of lesser light intensity of the light distribution.

SUMMARY OF THE INVENTION

The aim of the present invention is to produce a reflector for a vehicle headlight that is relatively simple to manufacture, in which the shape and the dimension of the sectors are optimised, thus minimising the number thereof and reducing the overall dimensions to a minimum.

The predetermined light distribution is obtained according to the invention by a reflector for a vehicle headlight having the characteristics defined in the claims.

In a reflector thus produced, the shape and the dimension of the sectors are not determined beforehand, as in U.S. Pat. No. 6,007,224, but optimised for each sector on the basis of the shape of the light source and the relative position of the latter with respect to the zone of the reflector that is in question. The number of sectors may thus be minimised, significantly simplifying the manufacture of the reflector dies, and the overall dimensions are reduced.

A further object of the invention is a method for the manufacture of such a reflector.

BRIEF DESCRIPTION OF THE DRAWINGS

A description will now be given of a preferred but non-limiting embodiment of the invention, referring to the appended drawings, in which.

DETAILED DESCRIPTION OF THE INVENTION

Figure 2:
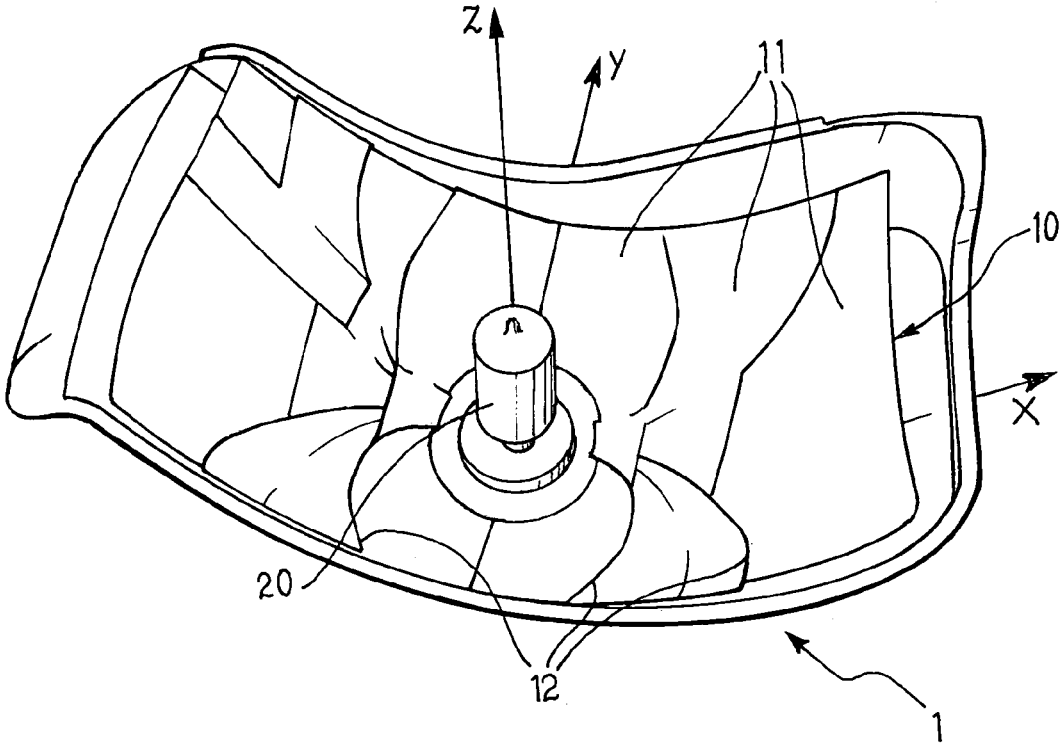
FIG. 2 is a perspective view of a motor vehicle headlight comprising a reflector according to the invention.
Figure 3:
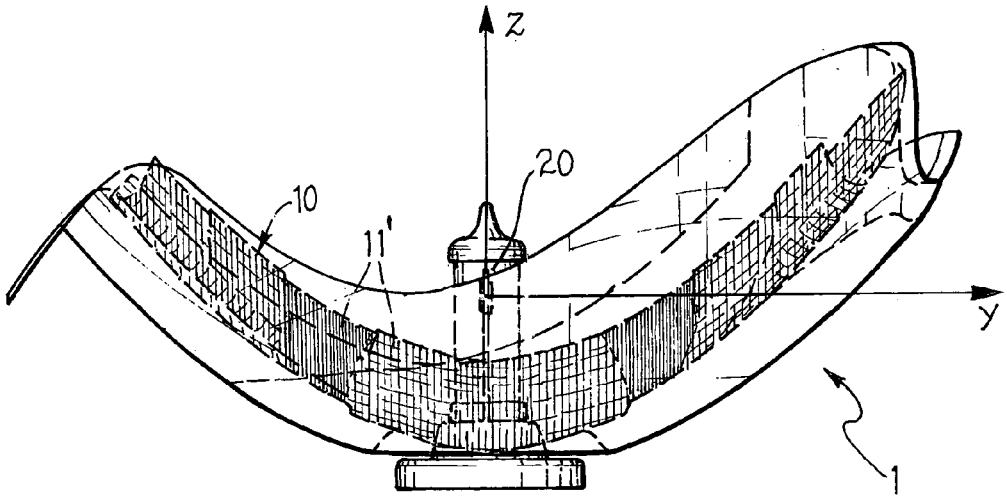
FIG. 3 is a diagrammatic view in side elevation of the headlight of FIG. 2.
Figure 4:
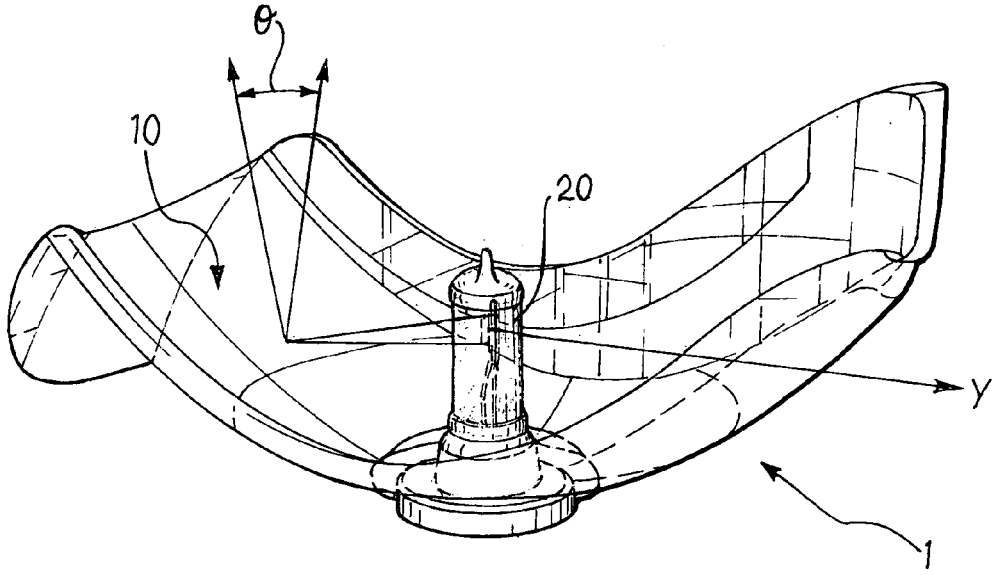
FIG. 4 is a diagrammatic perspective view of the headlight of FIG. 2.

With reference to FIGS. 2 to 4, a vehicle headlight 1 is illustrated on which a reflector 10 according to the invention is disposed in a known manner. The reflector 10 is obtained starting from a paraboloid surface cut into a shape which appears substantially rectangular in a plan view. The use of the paraboloid surface naturally constitutes only an example, the scope of the invention encompassing all those forms of surface suitable to be used for producing reflectors of vehicle headlights.

Here and hereinafter, the surface of the reflector 10 is to be understood to be disposed with respect to a Cartesian system of reference so that the axis z of that reference corresponds to the optical axis of the headlight, the axis x is parallel to the plane of the road and the axis y is perpendicular to the plane of the road.

Figure 1:
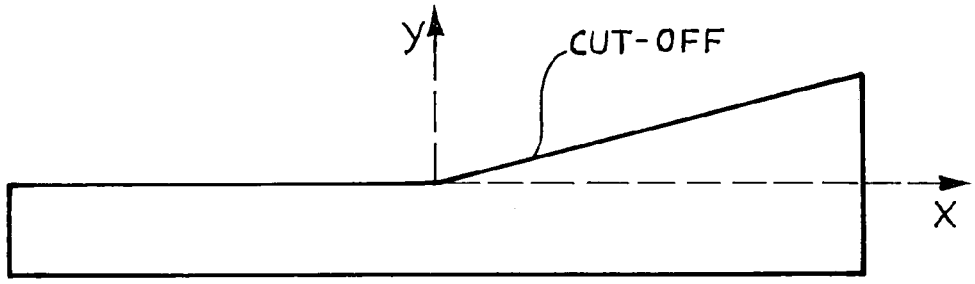
FIG. 1 is a schematic diagram which represents the light distribution generated by a headlight for motor vehicles according to the European standard.

The surface of the reflector 10 is sub-divided into a plurality of sectors 11 faceted so as to obtain the light distribution illustrated in FIG. 1. The sectors 11 are delimited by edge portions 12, the characteristics of which will be described hereinafter.

In one position of the reflector 10, in the present example substantially central, a light source 20 is disposed. The source may be any known type of source, for example a discharge or incandescent source, of the type used in motor vehicle headlights.

The reflector 10 described above is obtained according to the invention by means of the method described hereinafter.

First of all, the overall shape that the reflector 10 is to have is arranged according to the overall dimensions required within the vehicle and to aesthetic requirements. The shape may for example be that obtained starting from a paraboloid surface described in the preceding example.

A light source is then arranged, having a predetermined shape and geometric arrangement with respect to the reflector 10. As in the example described above, the source may be of the halogen type, with the filament of the source positioned in a known manner with the axis parallel to the optical axis z of the headlight (see FIG. 3). Reference will be made hereinafter to a type H7 halogen source.

On the surface of the reflector 10, boundary lines 12' are then determined, at the points of which the value of the angle of spread θ (or divergence) of the light beam reflected in the vertical direction of the axis y is constant. FIG. 4 illustrates by way of example the effect of angular spread by reflection generated by the surface of the reflector 10 on the beam coming from the light source 20 and incident at a specific point of the reflector 10.

In the case where the lamp of the source 20 is of type H7, it is possible to approximate the shape of the source 20 to a cylinder, and therefore calculate analytically the projection of the cylinder on the substantially paraboloid reflector 10.

It is therefore possible to obtain a mapping of the lines 12' with θ constant on the reflector 10. In the present example, such curves 12' are substantially segments of circumference having common tangent points on the optical axis of the reflector 10, and having centres positioned along the vertical axis y (see FIG. 5).

Figure 5:
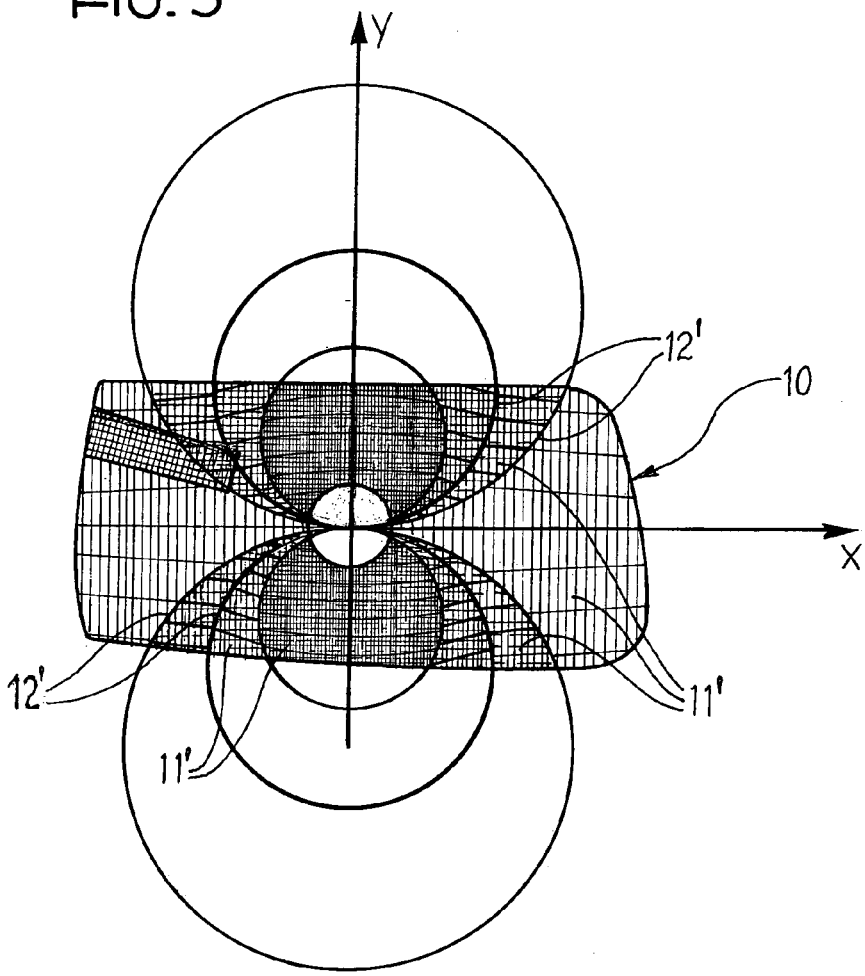
FIG. 5 is a plan view of the reflector of the headlight in FIG. 1, showing curves with constant values of the angle of spread θ of the light beam reflected along the axis y.

As can be seen in FIG. 5, the boundary lines 12' formed by the segments of circumference delimit on the surface of the reflector 10 regions 11' with variable values of the angle θ of vertical spread. In the figure, those regions 11' are shown filled by a grid pattern. In particular, in the regions 11' in which the grid pattern exhibits denser meshes, the angle of spread θ is greater. The white circular zone at the centre of the reflector 10 is occupied by the light source 20. The regions 11' with different value of the angle θ are also shown in FIG. 3.

In the case where the surface of the reflector 10 is different from that of a paraboloid, the lines 12' generated obviously have a different shape, for example substantially elliptical or also non-conical.

In the case where the shape of the source cannot be approximated to a cylinder, the analytical calculation described above becomes laborious or even impossible, so that recourse is had to conventional computing techniques, for example of the type based on non-sequential ray tracing codes.

Once the lines 12' with constant θ are defined, it is then possible to determine the sectors 11 in which to sub-divide the surface of the reflector 10, selecting them from among the regions 11' delimited by the boundary lines 12' and, naturally, by the edges of the reflector 10. At least some of the sectors 11 then correspond to respective regions 11', while the edges 12 of the sectors 11 coincide at least in part with the lines 12' with constant θ.

Figure 6:
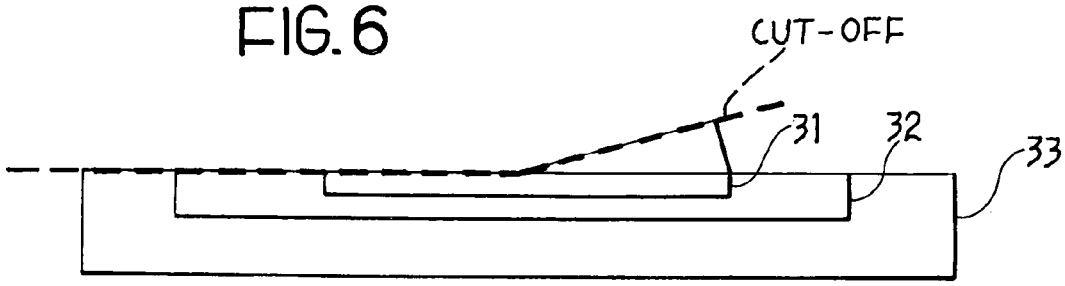
FIG. 6 is a diagram which once again illustrates the standard light distribution of FIG. 1, in which the regions having a higher gradient of illuminance are indicated.

After having determined the arrangement and the shape of the sectors 11 of the reflector 10, the corresponding surfaces are optimised in such a manner that the sectors having an angle of angular spread θ along the axis y with a lesser value contribute to the part of the light distribution of FIG. 1 having a greater spatial gradient, i.e. to the part closest to the cut-off line (indicated by the reference 31 in FIG. 6). In fact, the fact that the vertical angle of spread θ of these sectors is small makes it possible to have the illuminance peak closer to the cut-off line, i.e. in the region indicated by 31. The sectors having a progressively greater divergence θ will contribute to the formation of the light distribution in the progressively more extended regions about the region indicated by 31 (indicated by the references 32 and 33 in FIG. 6). Optimisation is effected by reconstructing the surface of the sectors so that the discontinuities with the contiguous sectors are minimal, and by rotating the sectors in such a manner that those with a lesser vertical angle of divergence are rotated less with respect to the optical axis in the direction of the positive axis y with respect to those with a greater vertical angle of divergence, in such a way that the sectors with lesser vertical divergence contribute to the zone 31 as indicated in FIG. 6.

The mapping of the surface of the reflector 10 further makes it possible to select the zone of the reflector 10 and to obtain the relative sectors to create the region of light distribution below the inclined section of the cut-off line, so that there is a minimal vertical divergence.

The reflector described above is suitable for being used both in headlights having a smooth transparent element and in headlights with an at least partially prismatic transparent element.

With the principle of the invention remaining unchanged, the details of production and the embodiments may of course be widely varied with respect to what has been described and illustrated, without thereby departing from the scope of the invention.

What is claimed is:

1. A reflector for a vehicle capable of illuminating the surrounding space according to a predetermined light distribution, said reflector comprising a plurality of sectors for reflecting a light beam emitted by a light source of a headlight and directing the light beam into predetermined regions of said light distribution, said light source having a predetermined shape and geometric arrangement with respect to said reflector;

wherein said sectors of the reflector are delimited by a plurality of edge portions which are designed so that each individual edge portion of said plurality of edge portions reflects the light beam with a divergence angle which is constant along the individual edge portion, said divergence angle being determined by the shape and geometric arrangement of said light source with respect to said reflector, and wherein the sectors delimited by edge portions having small divergence angles are arranged to direct the light beam reflected thereby into regions of the light distribution having a high spatial gradient of illuminance.

2. A reflector according to claim 1, wherein said light distribution has a demarcation line, above which an illuminance value is substantially zero and below which an illuminance value is substantially maximum, and at least a part of the sectors having small divergence angles is used to direct the light beam into a region of the light distribution close to the demarcation line.

3. A method for the manufacture of a reflector according to claim 1, comprising the steps of:

providing a shape of a surface of said reflector; and providing a light source having a predetermined shape and geometric arrangement with respect to said reflector;

wherein the method comprises the steps of:

determining, on the surface of said reflector, boundary lines formed of points at which a value of the divergence angle of the light beam reflected is constant;

distinguishing portions of said surface of the reflector contained between boundary lines having low values of the divergence angle; and arranging said sectors on the reflector so that at least some of these correspond to respective portions of the surface of the reflector, with at least some edge portions of the sectors coinciding with the boundary lines, such that said sectors are capable of directing the light beam reflected thereby into predetermined regions of the light distribution.

4. A method according to claim 3, wherein a cartesian system of reference is provided in which an axis coincides with an optical axis of the headlight, a second axis is parallel to the plane of the road, and a third axis is perpendicular to a plane of the road, and an angle of spread is evaluated in the direction of the optical axis.

5. A method according to claim 4, wherein the sectors of the reflector corresponding to portions of the surface of the reflector contained between boundary lines having low values of the divergence angle are arranged such as to be capable of directing the light beam reflected thereby into the regions of the light distribution with a high spatial gradient of illuminance.

6. A method according to claim 4, wherein the boundary lines are of substantially circular or elliptical shape, and have respective centres disposed in the direction of the third axis, being tangents to the second axis.

7. A method according to claim 6, wherein said boundary lines of substantially circular or elliptical shape are approximated by generic curves or segments of curves.

8. A vehicle headlight comprising a reflector according to claim 1, further comprising an at least partially prismatic transparent element.

* * * * *